US005809392A

United States Patent [19]

Tabuchi et al.

[11] Patent Number: 5,809,392

[45] Date of Patent: Sep. 15, 1998

[54] IMAGE FORMING APPARATUS FOR FORMING IMAGES ON SHEETS OF TWO TYPES

[75] Inventors: Hidehiro Tabuchi; Yoshiki Yoshioka; Junichi Oura; Koji Maeda, all of Osaka, Japan

[73] Assignee: Mita Industrial Co., Ltd., Osaka, Japan

[21] Appl. No.: 597,989

[22] Filed: Feb. 7, 1996

[30] Foreign Application Priority Data

Mar. 6, 1995 [JP] Japan ..... 7-045988

[51] Int. Cl.[6] ..... G03G 21/00

[52] U.S. Cl. ..... 399/405; 399/364; 399/38; 271/288

[58] Field of Search ..... 355/323, 321, 355/318, 319, 23, 24, 26; 271/298, 288; 399/364, 405, 38

[56] References Cited

U.S. PATENT DOCUMENTS 4,609,282 9/1986 Crandall ..... 271/298 X
4,994,847 2/1991 Tanaka et al. ..... 355/26
5,032,876 7/1991 Murakami ..... 355/324
5,452,058 9/1995 Umeda ..... 355/204

OTHER PUBLICATIONS

Japanese Unexamined Patent Publication No. 7–33317, published on Feb. 3, 1995.

*Primary Examiner*—R. L. Moses
*Attorney, Agent, or Firm*—Beveridge, Degrandi, Weilacher & Young, L.L.P.

[57] ABSTRACT

An image forming apparatus which forms identical images both on a sheet of a first type (overhead projector sheet) and on a sheet of a second type (normal paper sheet). One-side image formation is performed to form images on front sides of OHP sheets which are then discharged into a non-sort bin. Two-side image formation is performed to form images on the both sides of normal paper sheets which are then sorted and discharged into sort bins. Thus, sets of document sheets for presentation can be prepared in a sorted state. Since images are formed on both sides of the normal paper sheets, the normal sheets can be economized and saved.

20 Claims, 15 Drawing Sheets

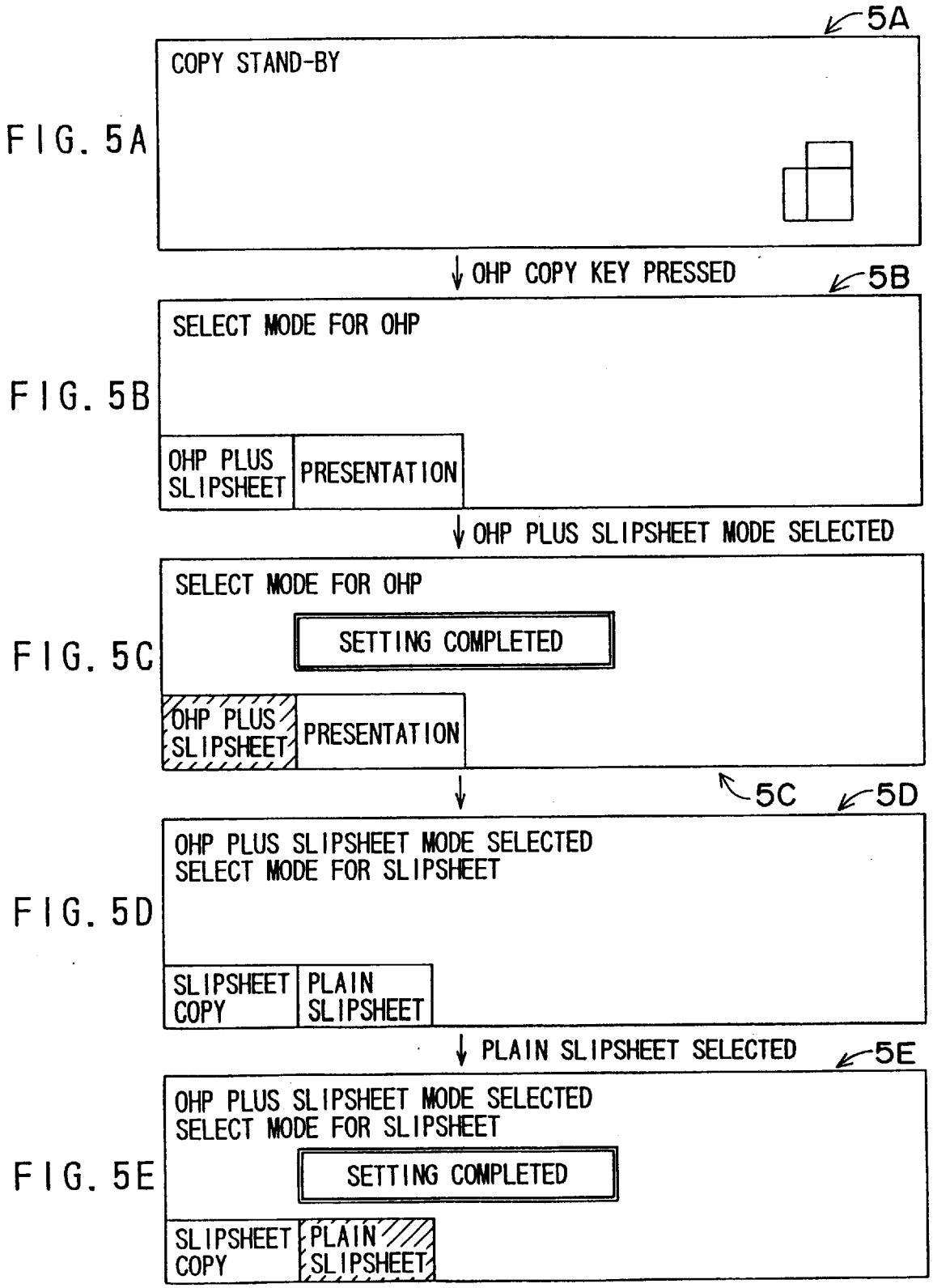
5A
COPY STAND-BY
FIG. 5A
OHP COPY KEY PRESSED
5B
SELECT MODE FOR OHP
FIG. 5B
OHP PLUS SLIPSHEET
PRESENTATION
OHP PLUS SLIPSHEET MODE SELECTED
SELECT MODE FOR OHP
SETTING COMPLETED
FIG. 5C
OHP PLUS SLIPSHEET
PRESENTATION
5C
5D
OHP PLUS SLIPSHEET MODE SELECTED
SELECT MODE FOR SLIPSHEET
FIG. 5D
SLIPSHEET COPY
PLAIN SLIPSHEET
PLAIN SLIPSHEET SELECTED
5E
OHP PLUS SLIPSHEET MODE SELECTED
SELECT MODE FOR SLIPSHEET
SETTING COMPLETED
FIG. 5E
SLIPSHEET COPY
PLAIN SLIPSHEET

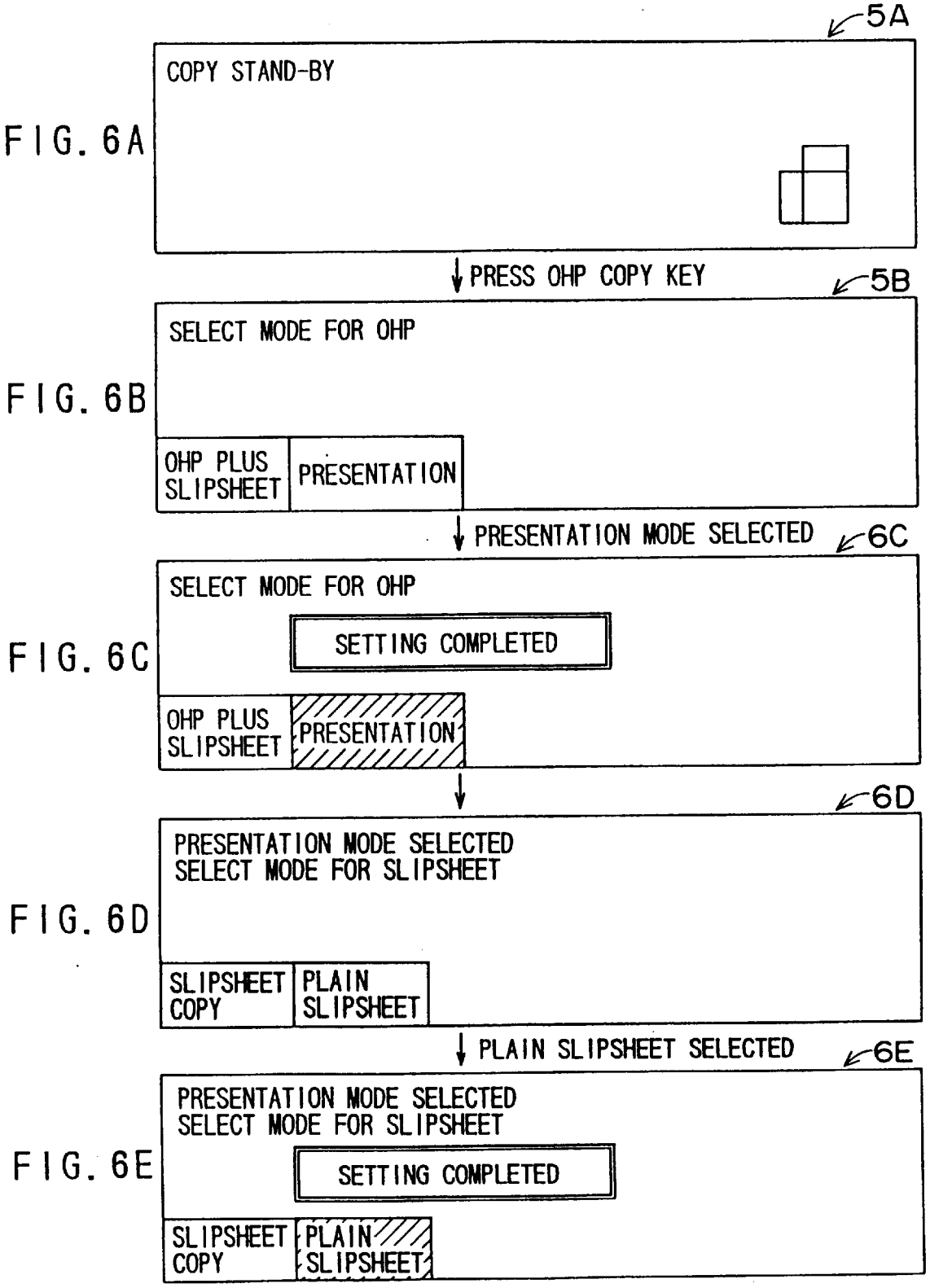
5A
COPY STAND-BY
FIG. 6A
PRESS OHP COPY KEY
5B
SELECT MODE FOR OHP
FIG. 6B
OHP PLUS SLIPSHEET
PRESENTATION
PRESENTATION MODE SELECTED
6C
SELECT MODE FOR OHP
SETTING COMPLETED
FIG. 6C
OHP PLUS SLIPSHEET
PRESENTATION
6D
PRESENTATION MODE SELECTED
SELECT MODE FOR SLIPSHEET
FIG. 6D
SLIPSHEET COPY
PLAIN SLIPSHEET
PLAIN SLIPSHEET SELECTED
6E
PRESENTATION MODE SELECTED
SELECT MODE FOR SLIPSHEET
SETTING COMPLETED
FIG. 6E
SLIPSHEET COPY
PLAIN SLIPSHEET

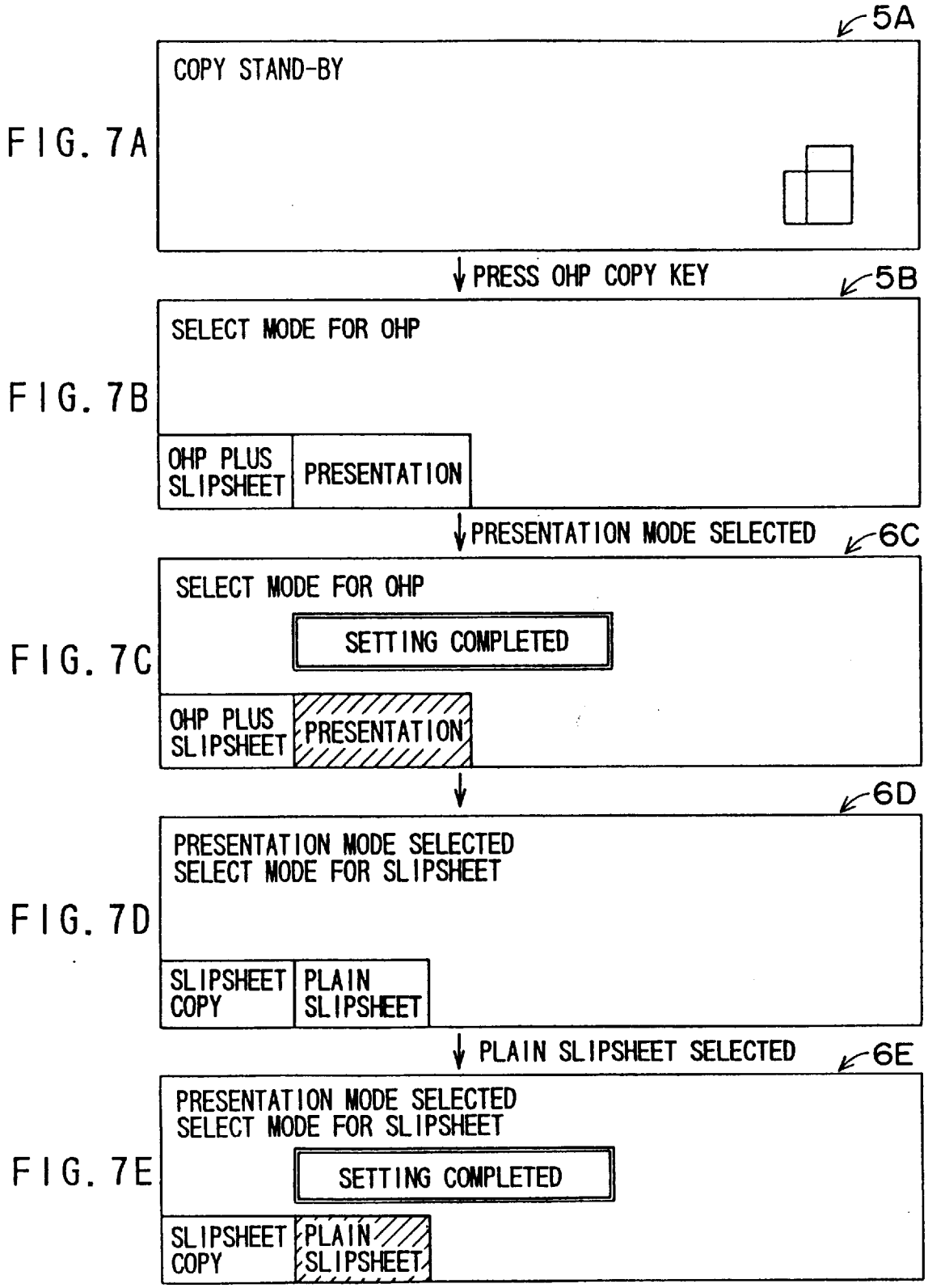
5A
COPY STAND-BY
FIG. 7A
PRESS OHP COPY KEY
5B
SELECT MODE FOR OHP
FIG. 7B
OHP PLUS SLIPSHEET
PRESENTATION
PRESENTATION MODE SELECTED
6C
SELECT MODE FOR OHP
SETTING COMPLETED
FIG. 7C
OHP PLUS SLIPSHEET
PRESENTATION
6D
PRESENTATION MODE SELECTED
SELECT MODE FOR SLIPSHEET
FIG. 7D
SLIPSHEET COPY
PLAIN SLIPSHEET
PLAIN SLIPSHEET SELECTED
6E
PRESENTATION MODE SELECTED
SELECT MODE FOR SLIPSHEET
SETTING COMPLETED
FIG. 7E
SLIPSHEET COPY
PLAIN SLIPSHEET

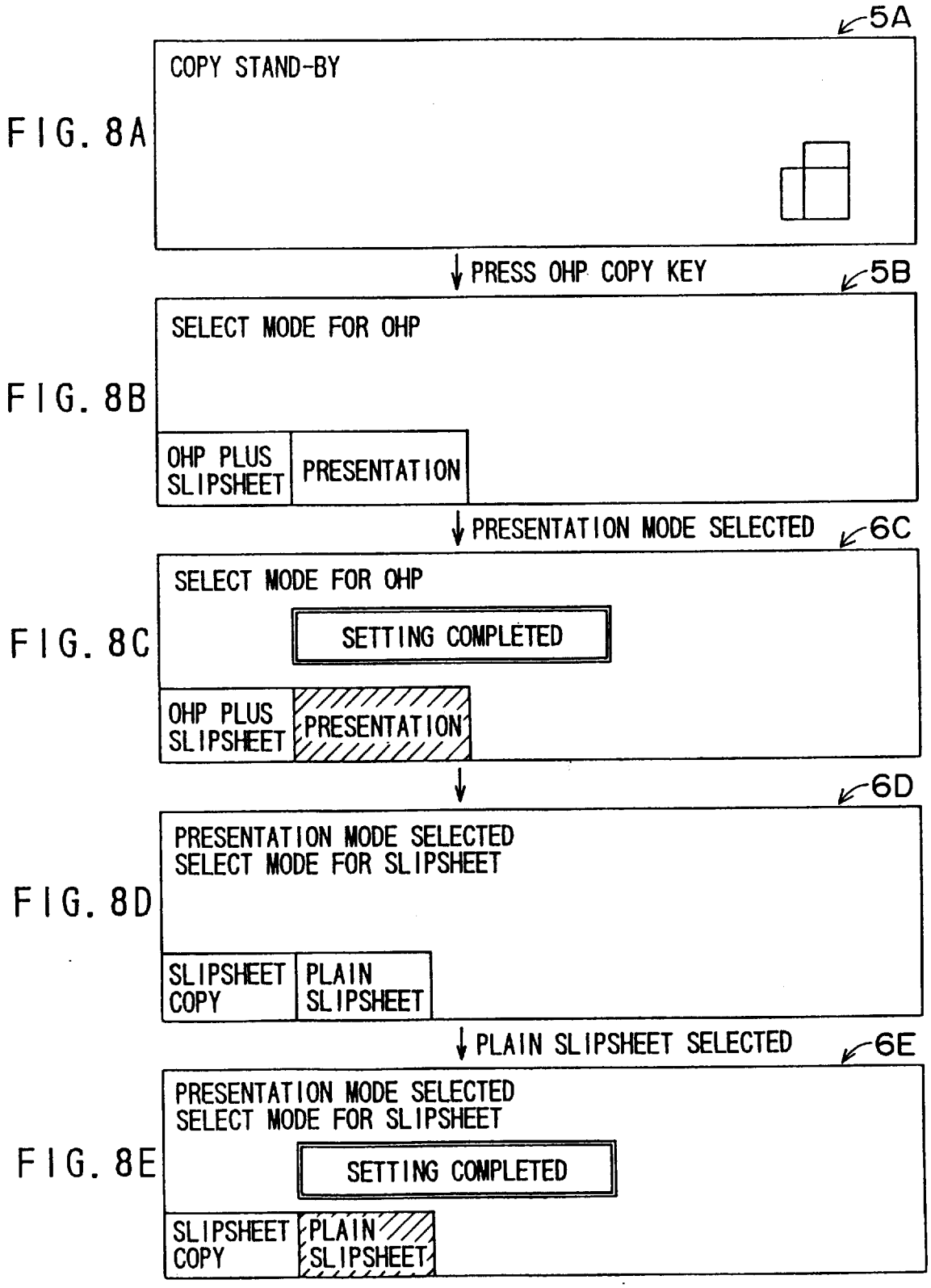
5A
COPY STAND-BY
FIG. 8A
PRESS OHP COPY KEY
5B
SELECT MODE FOR OHP
FIG. 8B
OHP PLUS SLIPSHEET
PRESENTATION
PRESENTATION MODE SELECTED
6C
SELECT MODE FOR OHP
SETTING COMPLETED
FIG. 8C
OHP PLUS SLIPSHEET
PRESENTATION
6D
PRESENTATION MODE SELECTED
SELECT MODE FOR SLIPSHEET
FIG. 8D
SLIPSHEET COPY
PLAIN SLIPSHEET
PLAIN SLIPSHEET SELECTED
6E
PRESENTATION MODE SELECTED
SELECT MODE FOR SLIPSHEET
SETTING COMPLETED
FIG. 8E
SLIPSHEET COPY
PLAIN SLIPSHEET

IMAGE FORMING APPARATUS FOR FORMING IMAGES ON SHEETS OF TWO TYPES

BACKGROUND OF THE INVENTION

1. Field of the Invention

The present invention relates to an image forming apparatus such as a copying machine.

2. Description of Related Art

Conventionally, copying machines have been widely used which electrophotographically make copies of a document original. Such copying machines are adapted to optically scan a document original, form an electrostatic latent image on a photoreceptor based on the scanned image, develop the electrostatic latent image into a toner image, and transfer the toner image onto a copy sheet, thereby making a copy of the document original. These copying machines, if necessary, are provided with an automatic document feeder for automatically feeding document originals one by one, and with a sorter for sorting and outputting copy sheets into a plurality of sheet receiving trays when a plurality of copies are made from a single document original.

The copying machines can form a copy image of a document original not only on a normal paper copy sheet (hereinafter referred to as "normal sheet") but also on a transparent sheet for an overhead projector (hereinafter referred to as "OHP sheet").

A copy image formed on an OHP sheet is illegible because the OHP is transparent. Therefore, some of the copying machines have an "OHP plus slipsheet" mode in which a slipsheet is automatically attached onto the back face of the OHP sheet. In the "OHP plus slipsheet" mode, a slipsheet is first discharged into the sheet receiving tray before a copy is made on an OHP sheet, and then the OHP sheet carrying a copy image of a document original is discharged into the sheet receiving tray. As a result, the slipsheet can be attached onto the back face of the OHP sheet.

In many cases, OHP sheets carrying copy images of document originals are used as material for a presentation at a meeting. For the presentation, document materials containing the same content as the OHP material are prepared for the participants in the meeting, typically, in the same number as the number of participants. In a conventional manner, copies are made on OHP sheets in the "OHP plus slipsheet" mode, and then a required number of copies are made on normal paper sheets in a usual copy mode.

To eliminate such troublesome operations, a copying machine having an OHP presentation mode is proposed in U.S. patent application Ser. No. 08/276,790 assigned to the assignee of the present application. In the OHP presentation mode, a slipsheet is attached onto the back face of each OHP sheet carrying a copy image of a document original and, at the same time, a required number of copies of the document original are made on normal sheets, which are then sorted and discharged into sheet receiving trays. The copying machine can simultaneously copy original images on OHP sheets and on normal paper sheets. In addition, the copying machine can sort and discharge the normal sheets formed with the copy images into a plurality of sheet receiving trays. Thus, the copying machine significantly simplifies the copying operation.

Where the copying machine is in the OHP presentation mode, a one-side copy mode is selected because of the nature of OHP sheets. When a copy is to be made on a normal sheet, a one-side copying operation is performed to copy an original image only on one side of the normal sheet.

However, it is desirable to perform a two-side copying operation as well as the one-side copying operation when copies are made on normal sheets. Thus, original images could be copied on the both sides of a normal sheet, so that normal sheets are economized.

SUMMARY OF THE INVENTION

It is an object of the present invention to provide an image forming apparatus which can perform a one-side image formation on a sheet of a first type which is then discharged into a predetermined sheet receiving tray, and perform a two-side image formation on a sheet of a second type which is then discharged into another sheet receiving tray.

It is another object of the present invention to provide an image forming apparatus which can sort sheets of the second type, each of which is formed with the same image as that formed on a sheet of the first type, separately from the sheet of the first type.

In accordance with the present invention, an image forming apparatus includes image forming means which is controlled to form images on front sides of sheets of the first type and to form the same images as those formed on the sheets of the first type on the both sides of sheets of the second type. The sheets of the first type formed with the images are discharged into predetermined one of a plurality of sheet receiving portions. The sheets of the second type are discharged into sheet receiving portions other than the predetermined sheet receiving portion.

Thus, images can be formed on the both sides of the sheets of the second type, so that the sheets of the second type sheets are economized.

The image forming apparatus preferably further includes a sorting mechanism for sorting and discharging a plurality of sheets of the second type respectively formed with identical images into the sheet receiving portions other than the predetermined sheet receiving portion. Thus, the sheets of the second type formed with the identical images can be obtained in a sorted state. This is particularly useful for preparation of plural sets of image-carrying sheets. Further, the sheets of the second type formed with the same images as those formed on the sheets of the first type can be obtained separately from the sheets of the first type.

Further, the image forming apparatus preferably discharges a sheet of a third type into the aforesaid predetermined sheet receiving portion before each of the sheets of the first type is discharged into the sheet receiving portion, thereby attaching the sheet of the third type onto the sheet of the first type. Where the sheets of the first type is a transparent sheet such as an OHP sheet, for example, an image formed on the transparent sheet can be easily seen.

Still further, the image forming means of the image forming apparatus may be controlled to form an image on a sheet of the third type. Thus, the image forming apparatus can be more conveniently used.

The sheet of the second type and the sheet of the third type may be of the same type.

The image forming apparatus preferably further includes first sheet retaining means for retaining sheets of the first type, second sheet retaining means for retaining sheets of the second type, and sheet feeding means for selectively feeding either a sheet of the first type retained in the first sheet retaining means or a sheet of the second type retained in the second sheet retaining means into the image forming means in association with the image formation to be performed by the image forming means.

The sheet of the first type may be a transparent sheet for an overhead projector, and the sheet of the second type may be a paper sheet.

The image forming apparatus may further include document original sheet feeding means for automatically feeding a document original sheet. In this case, the image forming means forms an image of a document original sheet fed by the document original sheet feeding means both on a sheet of the first type and on a sheet of the second type. Thus, the sheet of the first type and the sheet of the second type are respectively formed with identical images.

The document original sheet feeding means preferably includes document original sheet reversing means for successively presenting one side and the other side of a document original sheet at a document original presentation position. Thus, images of a two-sided document original sheet can be formed on the front side of sheet of the first type and on the both sides of a sheet of the second type.

The image forming apparatus preferably further includes presentation mode setting means for setting the operation mode thereof to a presentation mode which is suitable for preparation of presentation materials, and two-side mode setting means for setting the operation mode thereof to a two-side mode for image formation on the both sides of a sheet. Where the presentation mode is set by the presentation mode setting means and the two-side mode is set by the two-side mode setting means, one-side image formation on one side of a sheet of the first type and a two-side image formation on the both sides of a sheet of the second type are preferably effected.

Thus, where the presentation mode is set and the two-side mode is not set, the one-side image formation is performed to form an image on one side of a sheet of the second type. Where both the presentation mode and the two-side mode are set, the two-side image formation is performed to form images on the both sides of a sheet of the second type. This allows a user to perform desired image formation on the sheet of the second type by selecting the operation mode of the image forming apparatus. Thus, the image forming apparatus can be more conveniently used.

For the two-side image formation on the both sides of a sheet of the second type, the image forming apparatus preferably further includes an intermediate tray for temporarily accommodating a sheet of the second type formed with an image on one side thereof, and a two-side sheet feeding mechanism for introducing the sheet of the second type formed with the image on one side thereof into the intermediate tray and feeding the sheet of the second type from the intermediate tray to the image forming means for the next image formation on the other side of the sheet of the second type.

The foregoing and other objects, features and advantages of the present invention will become apparent from the following detailed description of preferred embodiments with reference to the attached drawings.

BRIEF DESCRIPTION OF THE DRAWINGS

FIGS. 5A to 5H are diagrams for explaining various screen images to be displayed for an "OHP plus slipsheet" mode setting operation;

FIGS. 6A to 6H are diagrams for explaining various screen images to be displayed for an OHP presentation mode setting operation when a one-side copying operation is to be performed to copy an original image on one side of a normal sheet;

FIGS. 7A to 7J are diagrams for explaining various screen images to be displayed for the OHP presentation mode setting operation when a two-side copying operation is to be performed to copy original images on the both sides of a normal sheet;

FIGS. 8A to 8J are diagrams for explaining various screen images to be displayed for the OHP presentation mode setting operation when a one-side copying operation is to be performed to copy images of a two-sided document original sheet or a book-type document original respectively on two normal sheets.

DETAILED DESCRIPTION OF PREFERRED EMBODIMENTS

Figure 1:
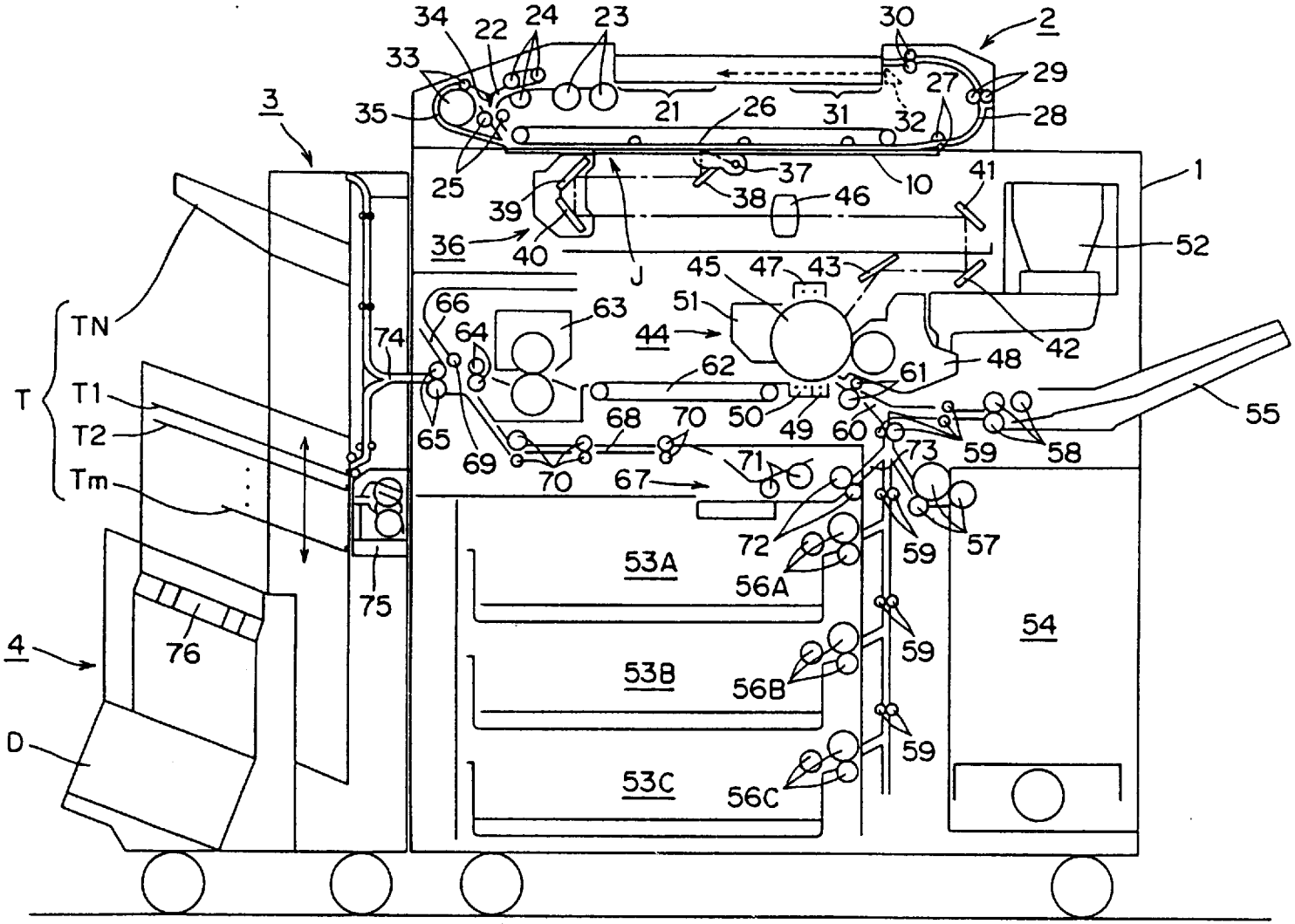
FIG. 1 is a schematic diagram illustrating an exemplary internal construction of a copying machine in accordance with one embodiment of an image forming apparatus of the present invention.

FIG. 1 is a schematic diagram illustrating an exemplary construction of a copying machine in accordance with one embodiment of an image forming apparatus of the present invention. The copying machine has a copying machine body 1, an automatic document original sheet feeder (hereinafter referred to as "RDH") 2 disposed on a top surface of the copying machine body 1, a sorter 3 for sorting and discharging copy sheets from the copying machine body 1 into a plurality of bins TN, T1, T2, . . . , Tm (hereinafter generally referred to as "bins T"), and a stacker 4 for collecting and stacking the copy sheets discharged to the bins T in a stack section D.

On the top surface of the copying machine 1 is disposed a transparent document original platen 10. When a copying operation is performed, a document original sheet to be copied is placed in an image formation position (light exposure position) J on the document original platen 10.

The RDH 2 automatically feeds a document original sheet to the image formation position J on the document original platen 10. The RDH 2 includes sheet feeding rollers 23, 24, 25, and a transportation belt 26, by means of which document original sheets set in a document original sheet setting position 21 are taken out one by one from the bottom thereof, and fed to the image formation position J through a sheet feeding path 22 extending to the document original platen 10.

The RDH 2 further includes reversing rollers 33 for reversing a two-sided document original sheet once fed to the image formation position J and feeding the document original sheet again to the image formation position J. The reversing rollers 33 are utilized where images on a two-sided document original sheet are copied on the both sides of a copy sheet in a two-side copy mode or where images on a two-sided document original sheet are respectively copied on two copy sheets in a separate copy mode. First the back side and then the front side of the two-sided document original sheet are subjected to a copying operation. Therefore, after once being fed to the image formation position J, the two-sided document original sheet is returned to the sheet feeding path 22 by the transportation belt 26. By reversing the rotation of the sheet feeding rollers 25 and blocking the sheet feeding path 22 by a separation claw 34, the two-sided document original sheet is introduced into a reversion path 35. The two-sided document original sheet introduced into the reversion path 35 is further transported through the reversion path 35 by the rotation of the reversing rollers 33 and led again to the image formation position J. Thus, upon completion of the copying operation for the back side of the two-sided document original sheet, the document original sheet is reversed by the operations of the reversing rollers 33 and the like, and the front side of the document original sheet is subjected to the copying operation.

After being subjected to the copying operation, the document original sheet on the document original platen 10 is transported to the right in FIG. 1 by the transportation belt 26. The document original sheet is led to a sheet discharging path 28 by sheet discharging rollers 27, and discharged to a document original sheet discharging position 31 through relay rollers 29 and sheet discharging rollers 30. After being discharged to the document original sheet discharging position 31, all the document original sheets are automatically set again in the document original sheet setting position 21 by a document original guide plate 32.

A document original reading section 36 is disposed in the copying machine body 1. The document original reading section 36 has a light source 37 for irradiating and scanning a document original sheet placed in the image formation position J on the document original platen 10. The light source 37 is reciprocally driven along the document original platen 10 in a transverse direction of FIG. 1 by a driving force from a motor for the optical system (not shown). Light emitted from the light source 37 is reflected on the document original sheet placed in the image formation position J. The light reflected on the document original sheet is further reflected on a first reflection mirror 38 driven unitedly with the light source 37, and further reflected on a second reflection mirror 39, a third reflection mirror 40, a fourth reflection mirror 41, a fifth reflection mirror 42 and a sixth reflection mirror 43 to be led to a photoreceptor drum 45 in an image formation section 44.

When the light source 37 is driven, the second reflection mirror 39 and third reflection mirror 40 are driven in a transverse direction of FIG. 1 at a speed half a speed at which the light source 37 is driven. Thus, the optical path length from the light source 37 to the photoreceptor drum 45 is kept constant during the scanning of the document original by the light from the light source 37. Between the third reflection mirror 40 and the fourth reflection mirror 41 is disposed a zoom lens 46 for forming a document original image on the photoreceptor drum 45.

The image formation section 44 includes the aforesaid photoreceptor drum 45 rotatively driven at a constant speed during the copying operation, and a main charger 47, a developing unit 48, a transfer charger 49, a separation charger 50 and a cleaning unit 51 which are disposed along the rotational direction around the photoreceptor drum 45 in the order named.

After being uniformly charged by the main charger 47, the surface of the photoreceptor drum 45 is exposed to the light reflected from the document original. As a result, an electrostatic latent image corresponding to a reversed document original image is formed on the surface of the photoreceptor drum 45. The electrostatic latent image is developed into a toner image with toner supplied from a toner hopper 52 in the developing unit 48. The toner image is transferred onto a copy sheet by the transfer charger 49. After the transfer of the toner image, residual toner present on the surface of the photoreceptor drum 45 is removed by the cleaning unit 51. The separation charger 50 serves to separate the copy sheet from the surface of the photoreceptor drum 45. The main charger 47, the transfer charger 49 and the separation charger 50 perform their respective functions by corona discharging.

The document original reading section 36 and the image formation section 44 will hereinafter be generally referred to as the "copying operation section", if necessary.

In synchronization with the copying operation performed by the image formation section 44, a copy sheet is fed from an upper deck 53A, a middle deck 53B, a lower deck 53C, a large volume deck 54 or a manual sheet feeding tray 55 (these decks and tray will hereinafter be generally referred to as "upper deck 53A and the like"). The upper deck 53A, middle deck 53B and lower deck 53C respectively accommodate copy sheets of different sizes. The large volume deck 54 accommodates a large amount of copy sheets of a size which is to be frequently used.

Sheet feeding rollers 56A, 56B, 56C, 57 and 58 for taking out copy sheets one by one are respectively disposed in positions relative to the upper deck 53A, the middle deck 53B, the lower deck 53C, and the larger volume deck 54 and the manual sheet feeding tray 55. During the copying operation, the sheet feeding rollers 56A, 56B, 56C, 57 or 58 are rotatively driven, thereby taking out a copy sheet from corresponding one of the upper deck 53A and the like. The copy sheet thus taken out is introduced to a sheet transportation path 60 extending to the vicinity of the photoreceptor drum 45 via relay rollers 59.

A pair of registration rollers 61 are disposed adjacent to the photoreceptor drum 45 on the sheet transportation path 60. The registration rollers 61 once stop the copy sheet, and then feed the copy sheet to the photoreceptor drum 45 in synchronization with the rotation of the photoreceptor drum 45. Thus, the copy sheet is fed to the photoreceptor drum 45 in such a timing as to be registered with the toner image formed on the surface of the photoreceptor drum 45 at the location of the transfer charger 49.

The copy sheet carrying the toner image transferred thereon by the transfer charger 49 is separated from the surface of the photoreceptor drum 45 by the separation charger 50, and then introduced to a fixation unit 63 by the transportation belt 62. The fixation unit 63 fixes the toner on the surface of the copy sheet. The copy sheet subjected to the fixation process is transported to the sorter 3 by transportation rollers 64 and sheet discharging rollers 65.

A copy sheet transportation path extending from the transportation rollers 64 to the sheet discharging rollers 65 branches into an intermediate path 68 and a reversion path 66 for reversing the copy sheet subjected to the fixation process. The intermediate path 68 serves to guide the copy sheet to an intermediate tray 67 disposed in a central portion of the copying machine body 1. Along the intermediate path 68 are disposed transportation rollers 70 at appropriate intervals. The intermediate tray 67 is used when the two-side copy mode or the separate copy mode is implemented.

In the two-side copy mode, a copy sheet subjected to the fixation process is once introduced into the reversion path 66 by a separation claw not shown and a reversion roller 69, and led to the intermediate path 68 by the reverse rotation of the reversion roller 69. Then, the copy sheet is accommodated in the intermediate tray 67. Copy sheets accommodated in the intermediate tray 67 are taken out one by one by sheet feeding rollers 71 and 72, then introduced into the transportation path 73 joining the sheet transportation path 60, and led again to the photoreceptor drum 45 through the sheet transportation path 60.

The sheet feeding rollers 56A, 56B, 56C, 57, 58, 71 and 72, the relay rollers 59, registration rollers 61, transportation rollers 64 and 70, and sheet discharging rollers 65 will hereinafter be generally referred to as the "copy sheet feeding section", if necessary.

The sorter 3 has the plurality of bins T, as described above. The copy sheet discharged by the sheet feeding rollers 65 is introduced into a sheet discharging path 74 and then led to a predetermined bin T by a sorting mechanism (not shown). Of the plurality of bins T, the bin TN is a non-sort bin which is used when copy sheets are discharged without being sorted after the copying operation. The bins T1 to Tm are used as sort bins for receiving copy sheets which are sorted after the copying operation.

The sorter 3 further includes punch/staple unit 75 for punching a plurality of copy sheets led to each of the sort bins T1 to Tm or stapling the plurality of copy sheets by means of a stapler. The sort bins T1 to Tm are vertically movable as shown in FIG. 1, so that a sort bin accommodating a set of copy sheets to be subjected to the punching or stapling process is moved to a position facing to the punch/staple unit 75.

The stacker 4 stacks the stack section D with sets of copy sheets each subjected to the stapling process in the punch/staple unit 75. The sets of copy sheets each subjected to the stapling process are taken out by means of a take-out device 76 in the stacker 4 and introduced to the stack section D.

The punching process, stapling process and stacking process will hereinafter be generally referred to as "post-process", if necessary. Electrical components including a sort bin driving section for driving the sort bins T1 to Tm, a punch/stapling unit driving section for driving the punch/staple unit 75 and a take-out device driving section for driving the take-out device 76 will hereinafter be generally referred to as the "post-processor", if necessary.

The copying machine according to this embodiment can use transparent sheets for an OHP (OHP sheets) as the first-type sheets and normal paper sheets as the second-type sheets. Where the OHP sheets are to be used as copy sheets, the "OHP plus slipsheet" mode is selected to attach a slipsheet on the back face of each OHP sheet subjected to the copying operation. In this case, the OHP sheet is fed from the manual sheet feeding tray 55, and the slipsheet is fed from one of the upper deck 53A, middle deck 53B, lower deck 53C and large volume deck 54. The OHP sheet formed with a copy image is discharged into the non-sort bin TN along with the slipsheet.

An OHP presentation mode can be selected to copy an original image both on an OHP sheet and on a plurality of normal paper sheets. In this case, the OHP sheet formed with a copy image of a document original is discharged into the non-sort bin TN along with a slipsheet, while the normal paper sheets each formed with a copy image of the document original are sorted and discharged into at least one of the sort bins T1 to Tm.

Figure 2:
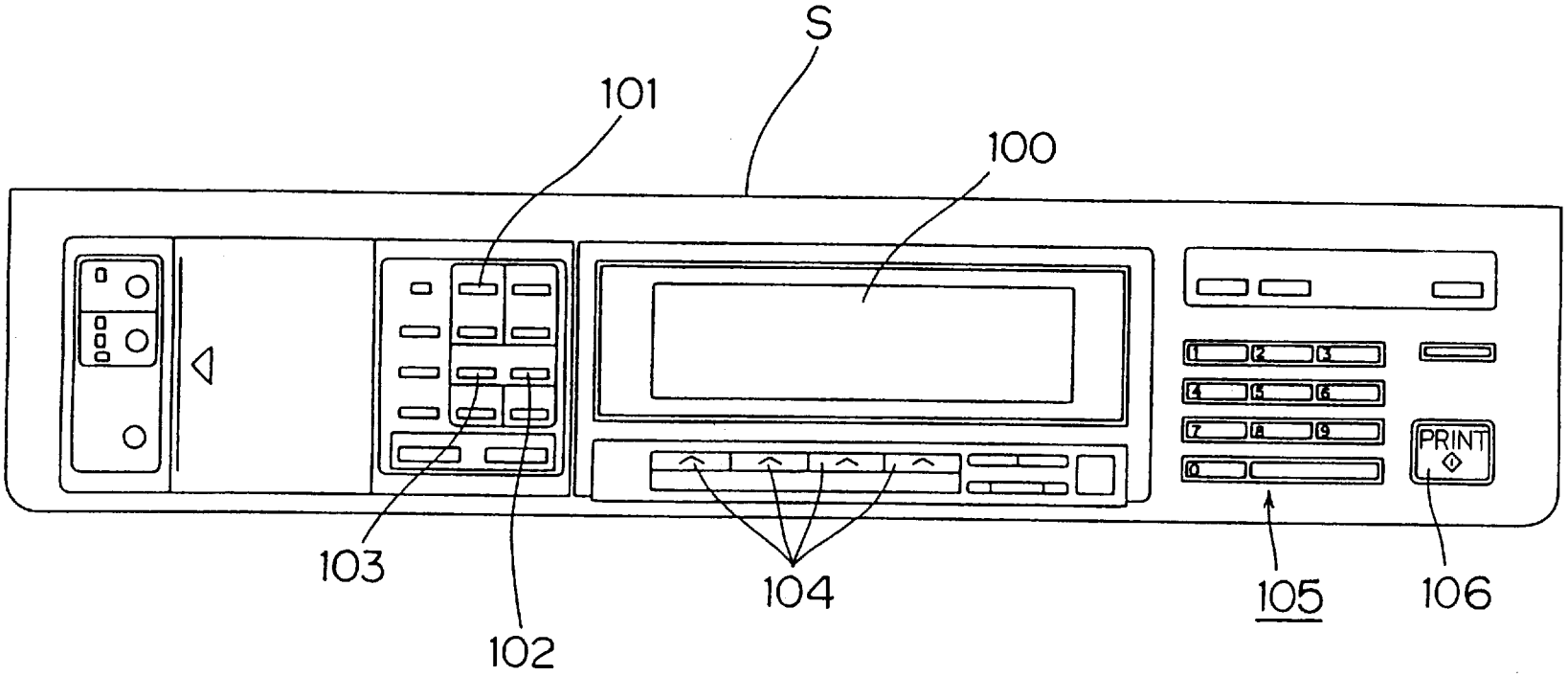
FIG. 2 is a plan view illustrating an exemplary external construction of an operation section of the copying machine.

FIG. 2 is a plan view illustrating the external construction of an operation section (not shown in FIG. 1) which is disposed on the front side of the top face of the copying machine body 1. The operation section S has a display portion 100 such as of a liquid crystal display device (LCD) disposed in the central portion thereof. On the left side of the display portion 100 in FIG. 2 are disposed an OHP copy key 101 which is to be pressed to select the "OHP plus slipsheet" mode or the OHP presentation mode, a two-side copy key 102 which is to be pressed to select the two-side copy mode, and a separate copy key 103 which is to be pressed to select the separate copy mode.

On the lower side of the display portion 100 in FIG. 2 are disposed a plurality of mode setting keys 104 for selecting any of plural options displayed in the display portion 100. The options are displayed in positions within the display portion 100 corresponding to the respective mode setting keys 104. The respective options are selected by operating the mode setting keys in the corresponding positions.

On the right side of the display portion 100 in FIG. 2 are disposed ten keys 105 for setting the number of copies to be made on OHP sheets or normal sheets from a single document original and a print key 106 for starting the copying operation.

Figure 3:
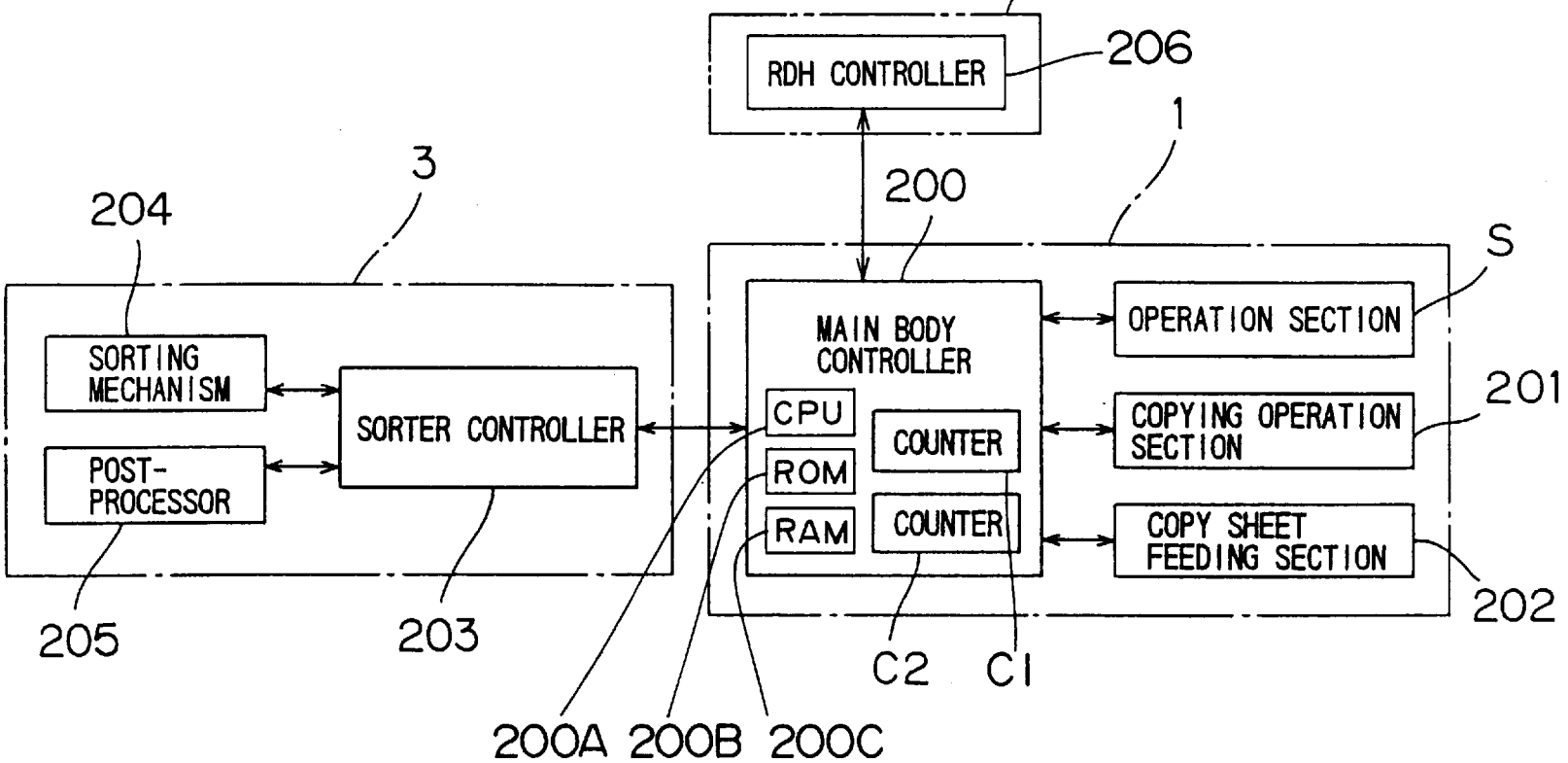
FIG. 3 is a block diagram illustrating the electrical construction of the copying machine.

FIG. 3 is a block diagram illustrating the electrical construction of the copying machine, mainly, the copying machine body 1 and the sorter 3. The copying machine body 1 includes a main body controller 200 comprising a microcomputer including a CPU 200A, a ROM 200B and a RAM 200C. The main body controller 200 further includes a counter C1 for counting the number of times of the copying operation performed on OHP sheets, and a counter C2 for counting the number of times of the copying operation performed on normal sheets. The main body controller 200 is connected to the operation section S, the copying operation section 201 and the copy sheet feeding section 202 which are respectively controlled thereby.

The sorter 3 has a sorter controller 203 comprising a microcomputer, like the main body controller 200. The operation of the sorter controller 203 is controlled by the main body controller 200. The sorter controller 203 is connected to the sorting mechanism 204 for sorting and discharging copy sheets formed with copy images into the nonsort bin TN or sort bins T1 to Tm, and a post-processor 205, which are under the control thereof.

The RDH 2 has an RDH controller 206 comprising a microcomputer and is connected to the main body controller 200. The RDH controller 206 controls motors (not shown) for driving the sheet feeding rollers 23, 24 and 25, the transportation belt 26 and the reversing rollers 33. The RDH controller 206 further controls a solenoid (not shown) for driving the separation claw 34. Thus, the RDH controller 206 controls the RDH 2 for feeding, reversing and discharging a document original sheet.

Figure 4A:
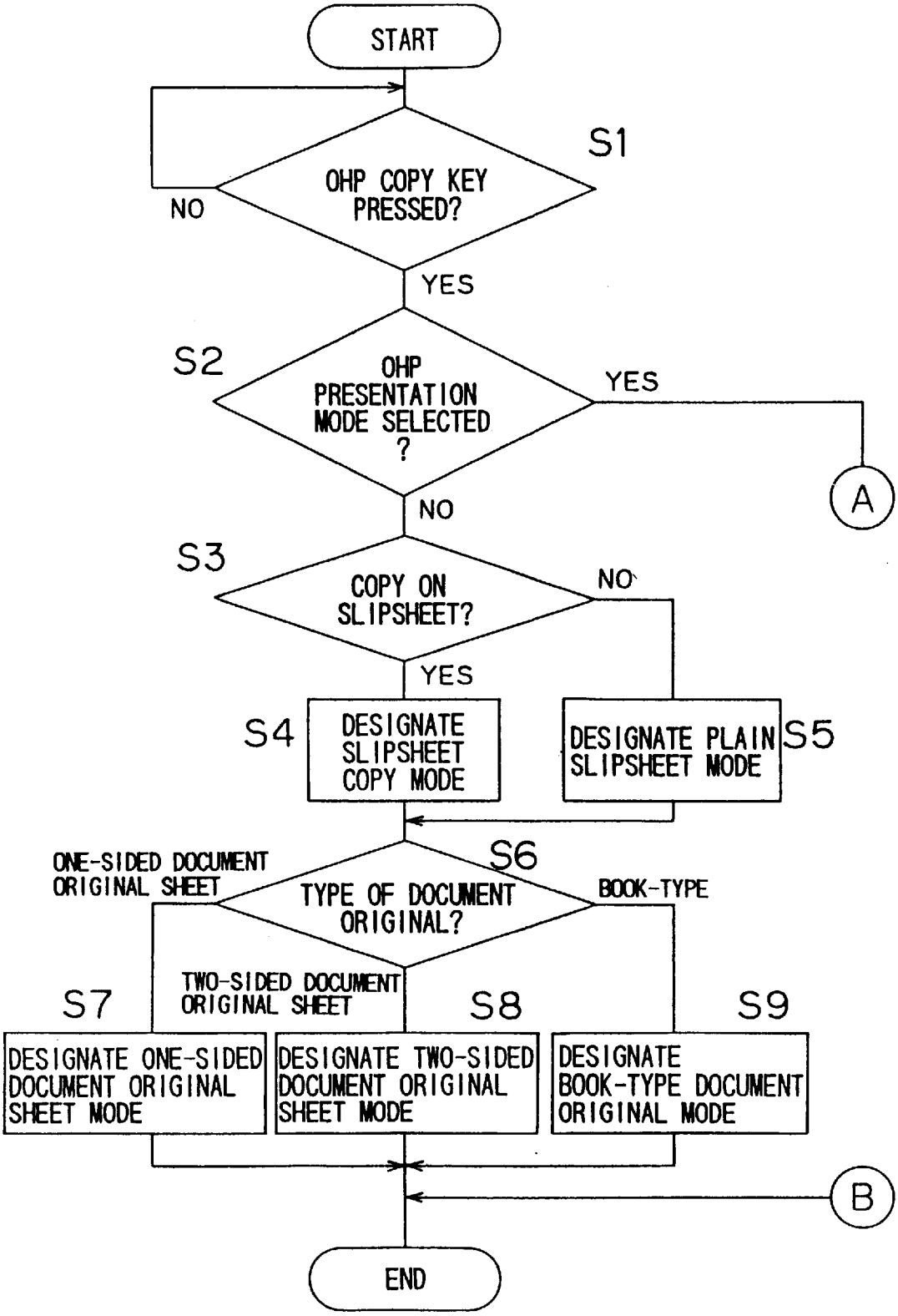
FIGS. 4A and 4B are flow charts for explaining operations for setting an "OHP plus slipsheet" mode and an OHP presentation mode.
Figure 4B:
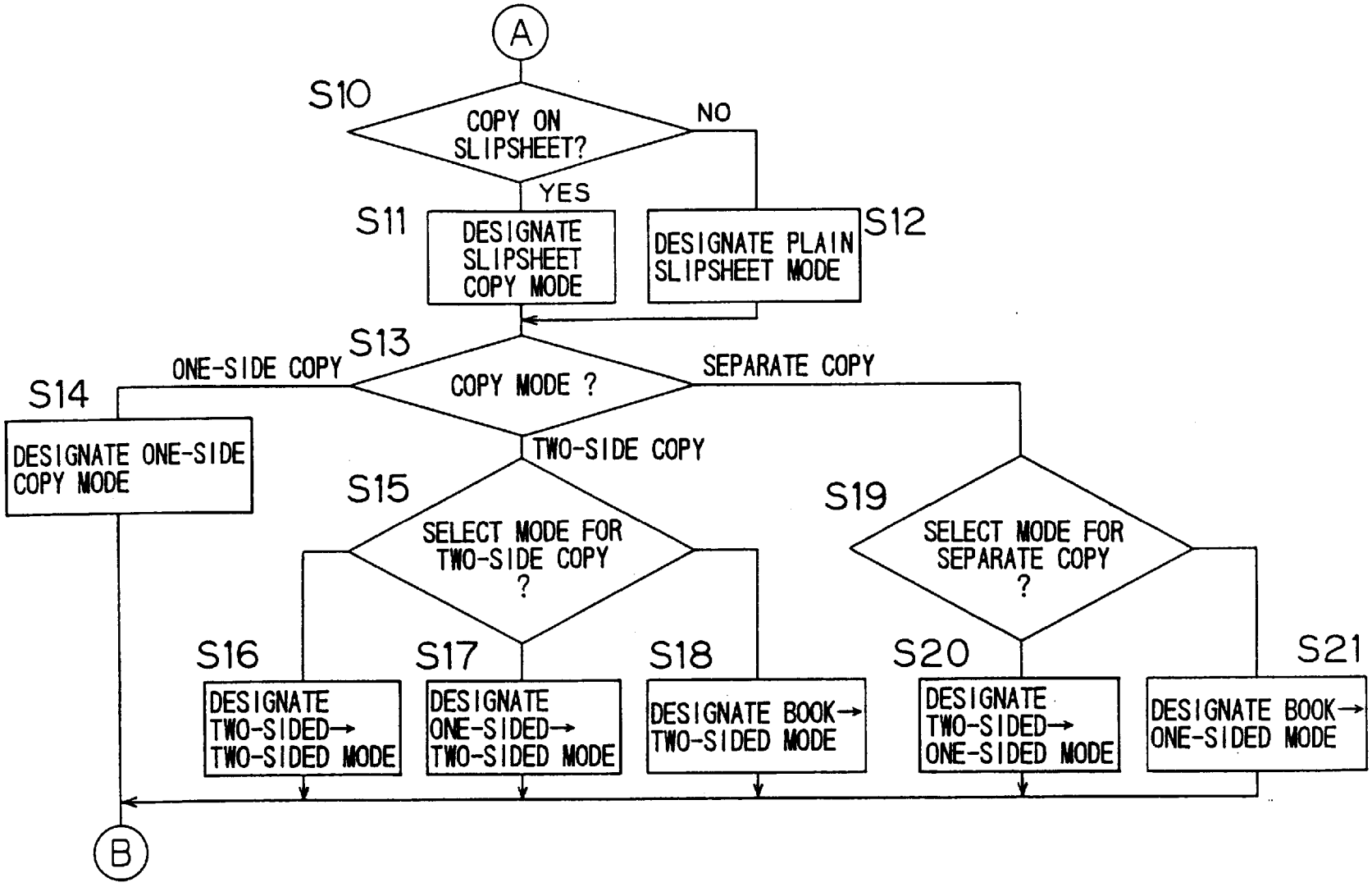

FIGS. 4A and 4B are flow charts for explaining operations of the main body controller 200 for setting the "OHP plus slipsheet" mode and the OHP presentation mode. The CPU 200A performs these operations based on predetermined programs stored in the ROM 200B. FIGS. 5A to 5H, 6A to 6H, 7A to 7J and 8A to 8J are diagrams for explaining various screen images to be displayed in the display portion 100 for setting either one of the aforesaid modes.

With reference to FIGS. 4A and 5A to 5H, there will be described a process sequence to be performed when the "OHP plus slipsheet" mode is selected.

When an operator presses the OHP copy key 101 in a state where a copy stand-by screen image 5A is displayed in the display portion 100 as shown in FIG. 5A (Step S1 of FIG. 4A), for example, an OHP mode selection screen image 5B is displayed as shown in FIG. 5B. The OHP mode selection screen image 5B includes a message of "SELECT MODE FOR OHP" and options of "OHP PLUS SLIPSHEET" and "PRESENTATION". If the "OHP plus slipsheet" mode is selected by pressing a corresponding mode setting key 104 ("NO" in Step S2 of FIG. 4A), a setting completion screen image 5C is displayed as shown in FIG. 5C. The setting completion screen image 5C includes a message of "SETTING COMPLETED" and a reverse-image indication of "OHP PLUS SLIPSHEET". Thus, the "OHP plus slipsheet" mode is designated.

Thereafter, a slipsheet mode selection screen image 5D is displayed as shown in FIG. 5D (Step S3 of FIG. 4A). The slipsheet mode selection screen image 5D includes a message of "OHP PLUS SLIPSHEET MODE SELECTED. SELECT MODE FOR SLIPSHEET" and options of "SLIPSHEET COPY" and "PLAIN SLIPSHEET". In the slipsheet mode selection screen image 5D, either a mode for copying an original image on a slipsheet to be attached to an OHP sheet or a mode for attaching a plain slipsheet on the OHP sheet is selected. If "PLAIN SLIPSHEET" is selected by pressing a corresponding mode setting key 104 ("NO" in Step S3), for example, a setting completion screen image 5E is displayed as shown in FIG. 5E (Step S5 of FIG. 4A). The setting completion screen image 5E includes a message of "SETTING COMPLETED" and a reverse-image indication of "PLAIN SLIPSHEET".

Figures 5F, 5G, 5H:
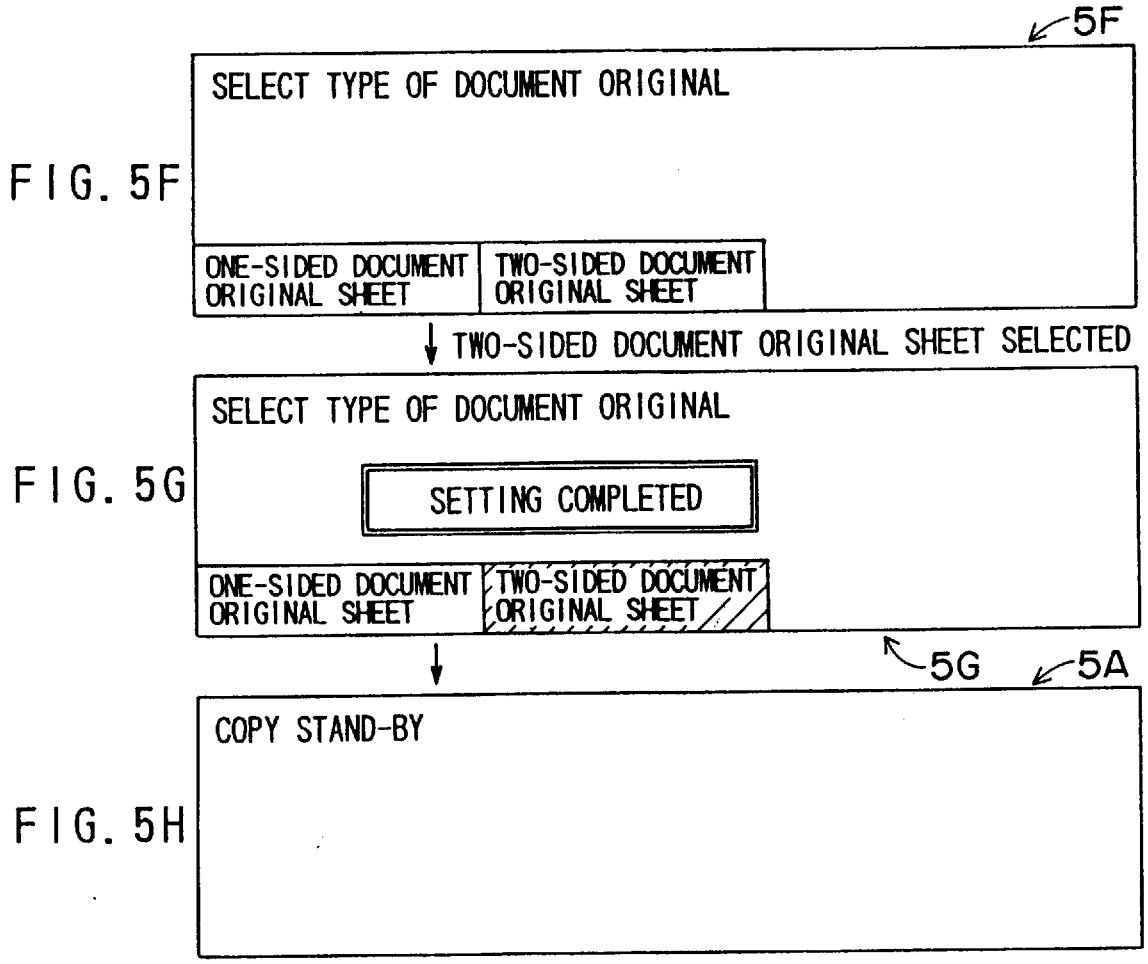

Subsequently, a document original type setting screen image 5F is displayed as shown in FIG. 5F (Step S6 of FIG. 4A). The document original type setting screen image 5F includes a message of "SELECT TYPE OF DOCUMENT ORIGINAL" and options of "ONE-SIDED DOCUMENT ORIGINAL SHEET" and "TWO-SIDED DOCUMENT ORIGINAL SHEET". If "TWO-SIDED DOCUMENT ORIGINAL SHEET" is selected by pressing a corresponding mode setting key 104 in the screen image 5F, for example, a setting completion screen image 5G is displayed as shown in FIG. 5G (Step S8 of FIG. 4A). The setting completion screen image 5G includes a message of "SETTING COMPLETED" and a reverse-image indication of "TWO-SIDED DOCUMENT ORIGINAL SHEET". Then, the usual copy stand-by screen image 5A is displayed as shown in FIG. 5H.

Though not shown in FIGS. 5F and 5G, the document original type setting screen image 5F may further include an option of "BOOK-TYPE DOCUMENT ORIGINAL" as shown in Step S9 of FIG. 4A.

With reference to FIGS. 4A, 4B and 6A to 6H, there will be described a process sequence to be implemented when the OHP presentation mode is selected and the one-side copying operation is to be performed to copy an original image on one side of a normal sheet.

If the OHP copy key 101 is pressed in a state where the copy stand-by screen image 5A is displayed as shown in FIG. 6A (Step S1 in FIG. 4A), an OHP mode selection screen image 5B is displayed in the display portion 100 as shown in FIG. 6B. If the option of "PRESENTATION" is selected by pressing a corresponding mode setting key 104 (YES in Step S2), a setting completion screen image 6C is displayed as shown in FIG. 6C. The setting completion screen image 6C includes a message of "SETTING COMPLETED" and a reverse-image indication of "PRESENTATION". Thus, the OHP presentation mode is designated.

Thereafter, a slipsheet mode selection screen image 6D is displayed as shown in FIG. 6D (Step S10 of FIG. 4B). The slipsheet mode selection screen image 6D includes a message of "PRESENTATION MODE SELECTED. SELECT MODE FOR SLIPSHEET". If "PLAIN SLIPSHEET" is selected in the screen image 6D ("NO" in Step S10 of FIG. 4B), for example, a setting completion screen image 6E is displayed as shown in FIG. 6E (Step S12 of FIG. 4B). The setting completion screen image 6E includes a message of "SETTING COMPLETED" and a reverse-image indication of "PLAIN SLIPSHEET".

Figures 6F, 6G, 6H:
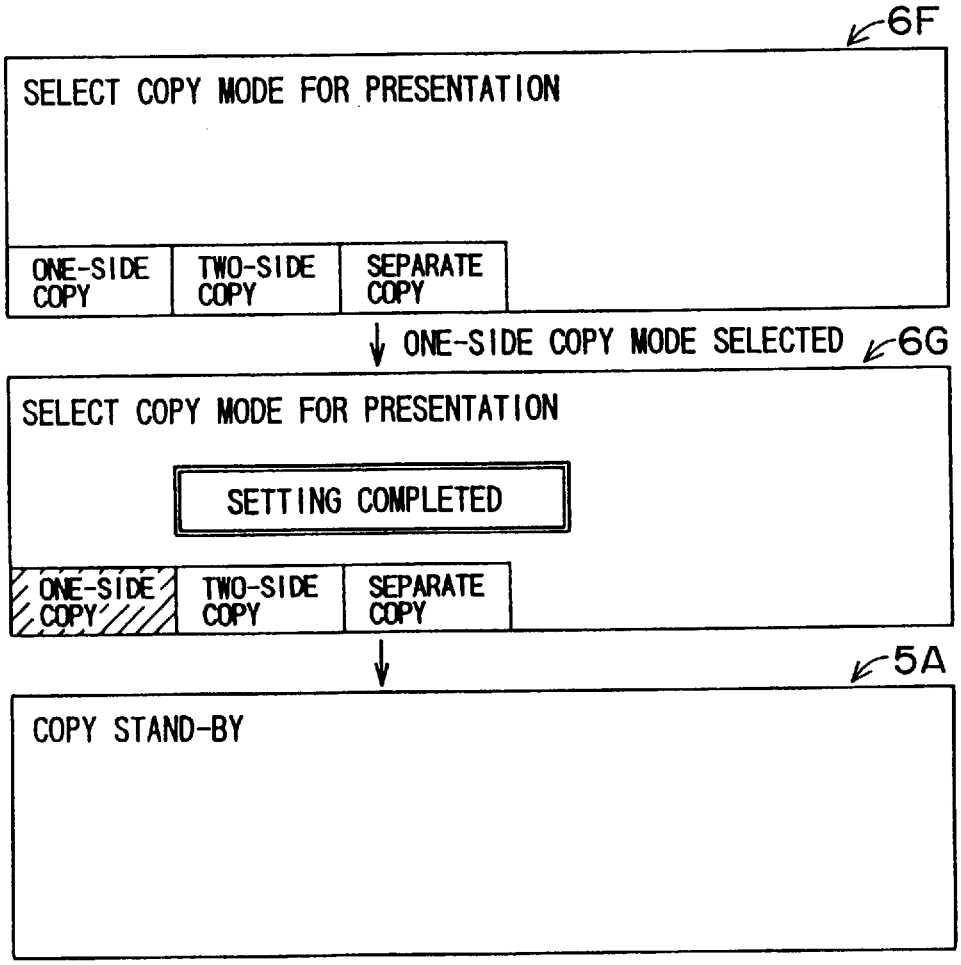

Subsequently, a presentation copy mode selection screen image 6F (see FIG. 6F) for selecting a copy mode for normal sheets for presentation is displayed in the display portion 100 (Step S13 of FIG. 4B). The presentation copy mode selection screen image 6F includes a message of "SELECT COPY MODE FOR PRESENTATION" and options of "ONE-SIDE COPY", "TWO-SIDE COPY" and "SEPARATE COPY". If "ONE-SIDE COPY" is selected, the one-side copying operation is performed to copy an original image on one side of a normal sheet. If "TWO-SIDE COPY" is selected, the two-side copying operation is performed to copy original images on the both sides of a normal sheet. If "SEPARATE COPY" is selected, images on the both sides of a two-sided document original sheet or images on right and left pages of a book-type document are respectively copied on front sides of two copy sheets. When "ONE-SIDE COPY" is selected in the presentation copy mode selection screen image 6F, for example, a setting completion screen image 6G is displayed as shown in FIG. 6G (Step S14 of FIG. 4B). The setting completion screen image 6G includes a message of "SETTING COMPLETED" and a reverse-image indication of "ONE-SIDE COPY". Then, the usual copy stand-by screen image 5A is displayed as shown in FIG. 6H.

With reference to FIGS. 4B and 7A to 7J, there will be described a process sequence to be implemented when the OHP presentation mode is selected and the two-side copying operation is to be performed to copy original images on the both sides of a normal sheet. The steps corresponding to the display screen images shown in FIGS. 7A to 7F are the same as the steps corresponding to the display screen images shown in FIGS. 6A to 6F. Therefore, these steps will not be described, and an explanation will be started from the step corresponding to a display screen image shown in FIG. 7G.

Figures 7F, 7G, 7H, 7I, 7J:
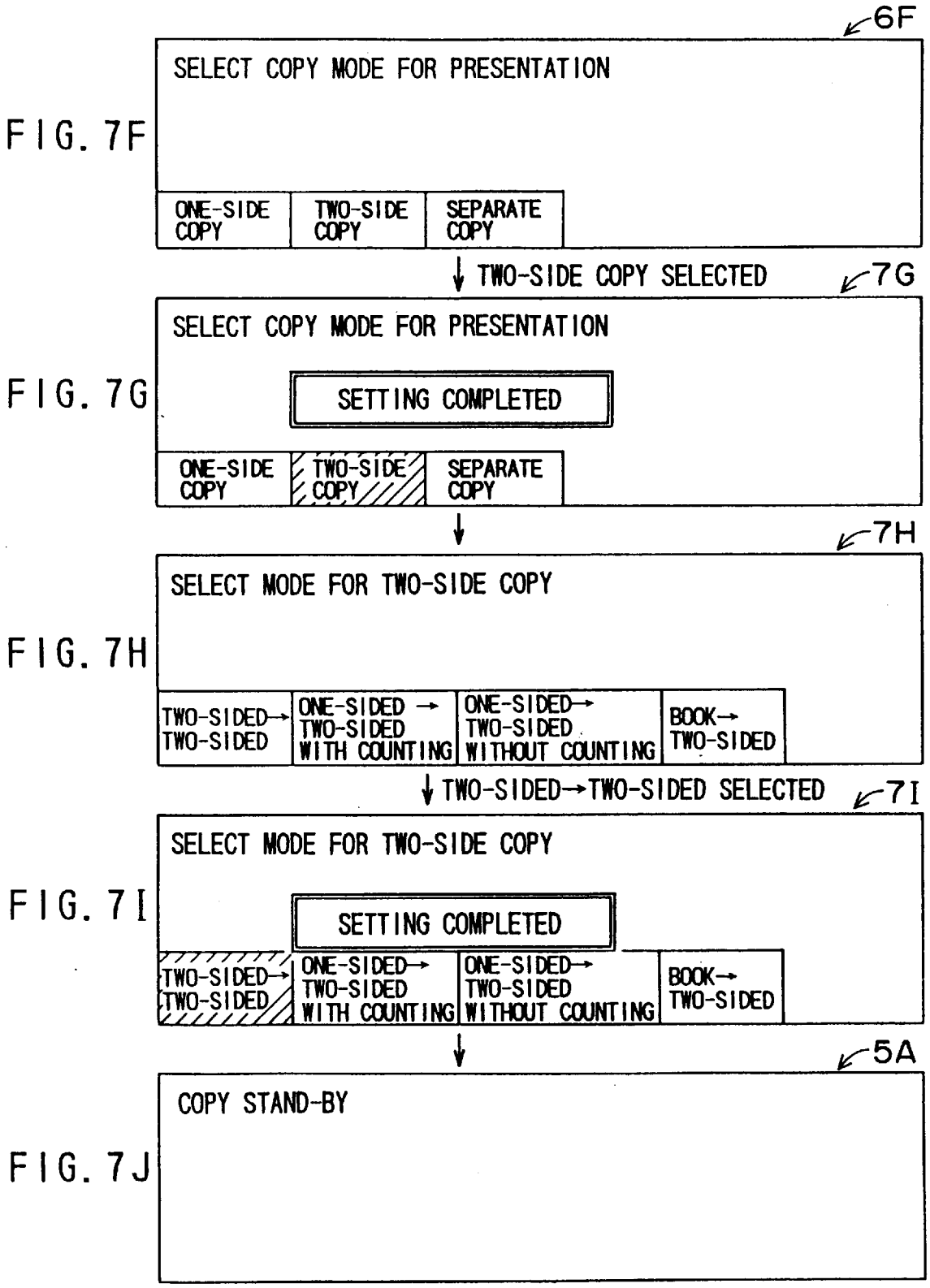

If "TWO-SIDE COPY" is selected in a state where the presentation copy mode selection screen image 6F is displayed as shown in FIG. 7F, for example, a setting completion screen image 7G is displayed as shown in FIG. 7G. The setting completion screen image 7G includes a message of "SETTING COMPLETED" and a reverse-image indication of "TWO-SIDE COPY". Then, a two-side copy mode selection screen image 7H for selecting one of options for the two-side copy mode is displayed (Step S15 of FIG. 4B). The two-side copy mode selection screen image 7H includes a message of "SELECT MODE FOR TWO-SIDE COPY" and options of "TWO-SIDED→TWO-SIDED", "ONE-SIDED→TWO-SIDED WITH COUNTING", "ONE-SIDED→TWO-SIDED WITHOUT COUNTING" and "BOOK→TWO-SIDED". The first option of "TWO-SIDED→TWO-SIDED" corresponds to an operation for copying images of a two-sided document original sheet on the both sides of a copy sheet. The second option of "ONE-SIDED→TWO-SIDED WITH COUNTING" corresponds to an operation for copying images of one-sided document original sheets on the both sides of a copy sheet while counting the number of times of the copying operation. The third option of "ONE-SIDED→TWO-SIDED WITHOUT COUNTING" corresponds to an operation for copying images of one-sided document original sheets on the both sides of a copy sheet without counting the number of times of the copying operation. The fourth option of "BOOK→TWO-SIDED" corresponds to an operation for copying images of a book-type document original on the both sides of a copy sheet. If "TWO-SIDED→TWO-SIDED" is selected in the two-side copy mode selection screen image 7H, for example, a setting completion screen image 7I is displayed as shown in FIG. 7I (Step S16 of FIG. 4B). The setting completion screen image 7I includes a message of "SETTING COMPLETED" and a reverse-image indication of the option of "TWO-SIDED→TWO-SIDED". Then, the usual copy stand-by screen image 5A is displayed as shown in FIG. 7J. Thus, both the two-side copy mode and the OHP presentation mode are designated.

With reference to FIGS. 4B and 8A to 8J, there will be described a process sequence to be performed when the OHP presentation mode is selected and images of a two-sided document original sheet or of a book-type document original are respectively copied on the front sides of two normal sheets. The steps corresponding to the display screen images shown in FIGS. 8A to 8F are the same as the steps corresponding to the display screen images shown in FIGS. 6A to 6F. Therefore, these steps will not be described, and an explanation will be started from the step corresponding to a display screen image shown in FIG. 8G.

Figures 8F, 8G, 8H, 8I, 8J:
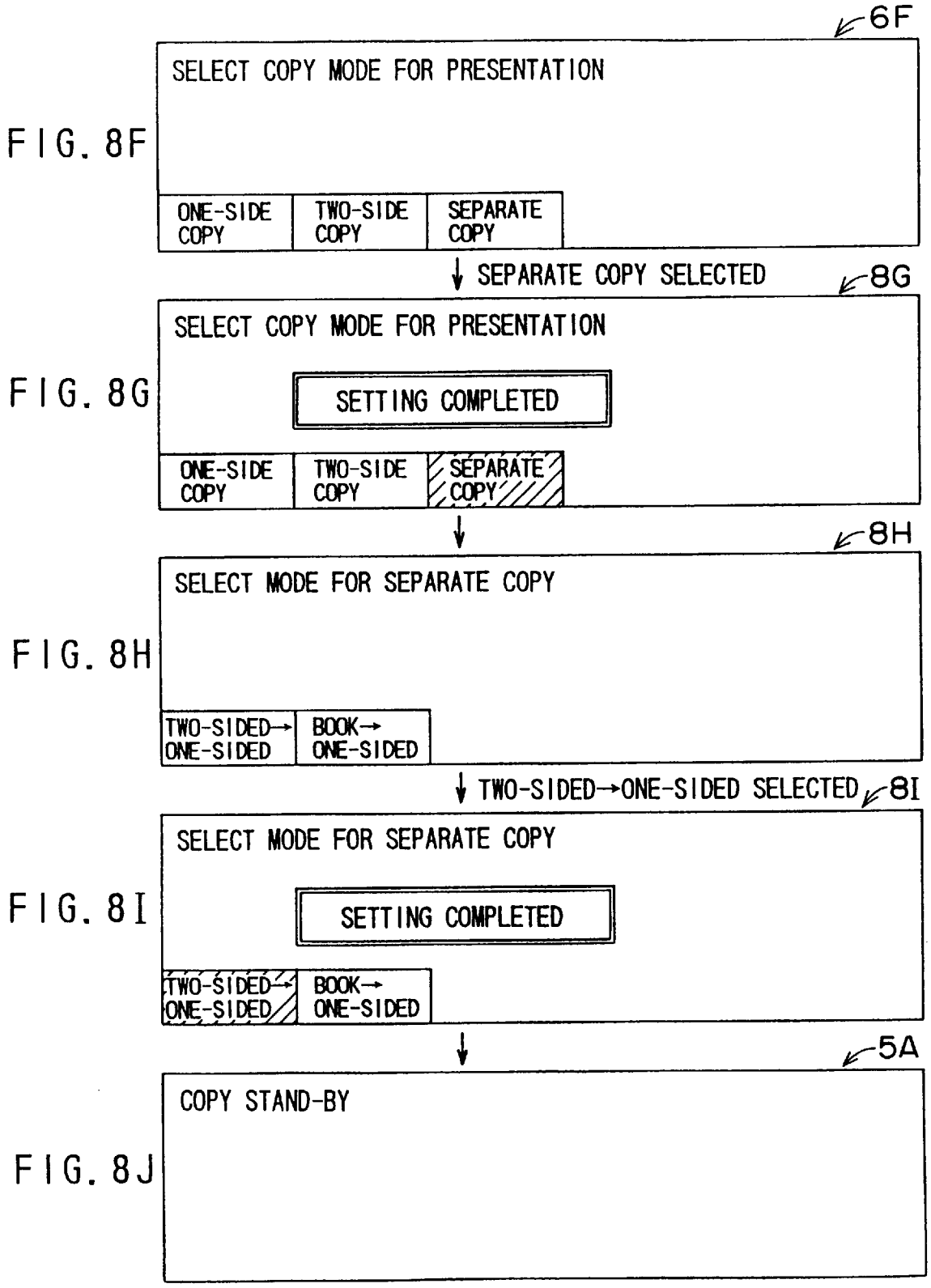

When "SEPARATE COPY" is selected in a state where the presentation copy mode selection screen image 6F (see FIG. 8F) for selecting a copy mode for normal sheets is displayed, for example, a setting completion screen image 8G is displayed as shown in FIG. 8G. The setting completion screen image 8G includes a message of "SETTING COMPLETED" and a reverse-image indication of "SEPARATE COPY". Thereafter, a separate copy mode selection screen image 8H (see FIG. 8H) for selecting one of the options for the separate copy mode is displayed (Step S19 of FIG. 4B). The separate copy mode selection screen image 8H includes a message of "SELECT MODE FOR SEPARATE COPY" and options of "TWO-SIDED→ONE-SIDED" and "BOOK→ONE-SIDED". The first option of "TWO-SIDED→ONE-SIDED" corresponds to an operation for copying images of a two-sided document original sheet respectively on two copy sheets. The second option of "BOOK→ONE-SIDED" corresponds to an operation for copying images of a book-type document original respectively on two copy sheets. If "TWO-SIDED→ONE-SIDED" is selected in the separate copy mode selection screen image 8H, for example, a setting completion screen image 8I is displayed as shown in FIG. 8I (Step S18 of FIG. 4B). The setting completion screen image 8I includes a message of "SETTING COMPLETED" and a reverse-image indication of "TWO-SIDED→ONE-SIDED". Thereafter, the usual copy stand-by screen image 5A is displayed as shown in FIG. 8J.

When the operator presses the print key 106 in a state where the copy stand-by screen image 5A shown FIG. 5H, 6H, 7J or 8J is displayed, for example, a copying operation is started in the "OHP plus slipsheet" mode or OHP presentation mode.

Figure 9A:
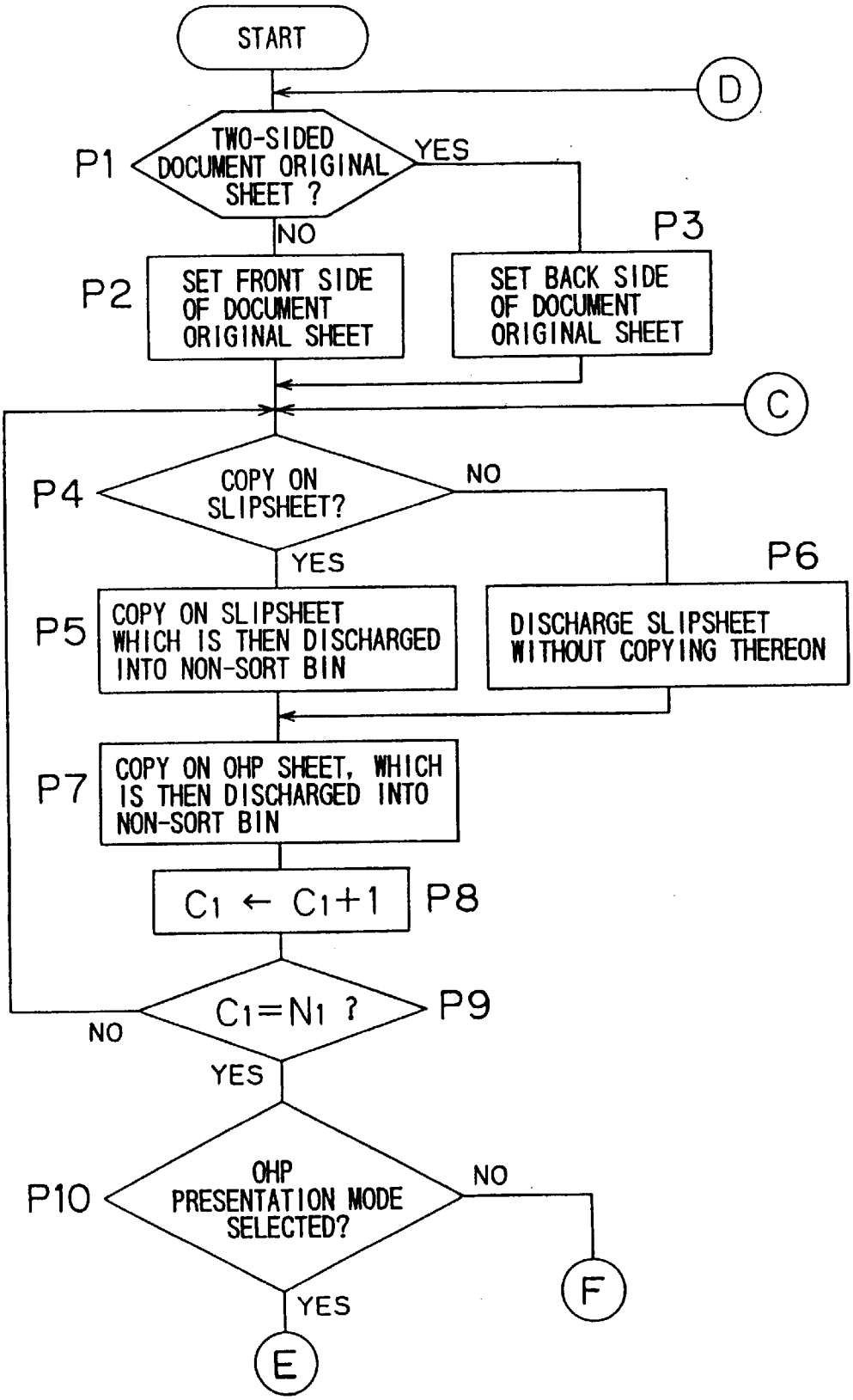
FIGS. 9A and 9B are flow charts for explaining the operations of the copying machine.
Figure 9B:
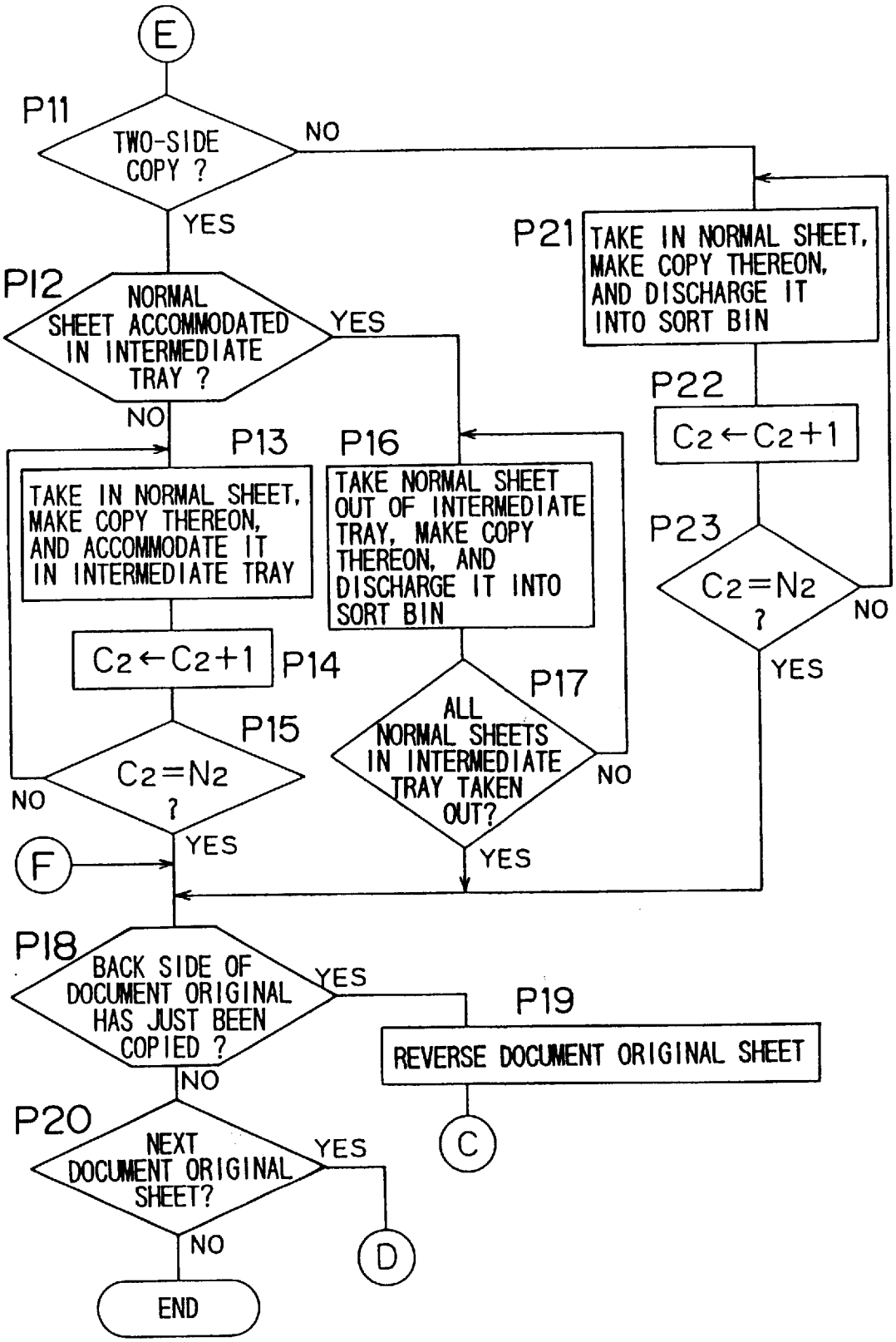

FIGS. 9A and 9B are flow charts for explaining the copying operations. To perform the operations shown in the flow charts, the CPU 200A operates based on predetermined programs stored in the ROM 200B, and the main body controller 200 thereby controls the respective components of the copying machine. An explanation will hereinafter be given mainly to the copying operation for two-sided document original sheets.

When the OHP copy key 101 is pressed to select the "OHP plus slipsheet" mode or OHP presentation mode and the print key 106 is pressed in a state where document original sheets are set in the document original setting position 21 on the RDH 2, it is first judged whether or not the document original sheets set in the position are two-sided (Step P1). If two-sided, one of the document original sheets is fed to the image formation position J with the back side thereof facing downward after being reversed (Step P3). On the other hand, if not two-sided, one of the document sheets is fed to the image formation position J with the front side thereof facing downward without being reversed (Step P2).

In turn, it is judged whether or not a mode for copying an original image on a slipsheet to be attached onto an OHP sheet is selected (Step P4). If YES, the copy sheet feeding section 202 and the copying operation section 201 are controlled to take in a slipsheet. The original image is copied on the slipsheet, which is then discharged into the non-sort bin TN (Step P5). If NO, a slipsheet is taken in and discharged into the non-sort bin TN without being subjected to the copying operation (Step P6). Thereafter, an OHP sheet is taken out of the manual sheet feeding tray 55, and the original image is copied on the OHP sheet, which is then discharged into the non-sort bin TN (Step P7). As a result, the slipsheet is attached onto the back face of the OHP sheet formed with a copy image.

In association with the operation in Step P7, the main body controller 200 increments the counter C1 to count the number $C_1$ of OHP sheets on which copies are made (Step P8). Then, it is judged whether or not the count value $C_1$ reaches a number $N_1$ which is preliminarily inputted from the operation section S in the mode setting to set the number of copies to be made on OHP sheets (Step P9). If it is determined that the count value $C_1$ does not reach the number $N_1$, the process sequence from Step P4 to Step P8 is implemented again.

The OHP sheets formed with copy images are typically used for presentation and, therefore, the number is generally set to $N_1=1$. In this case, the process sequence from Step P4 to Step P8 is performed once and is not repeated.

If it is determined in Step P9 that the count value $C_1$ reaches the number $N_1$, it is judged whether or not the OHP presentation mode is selected (Step P10). If it is determined that the OHP presentation mode is selected, the process enters step P11 shown in FIG. 9B. On the other hand, if it is determined that the OHP presentation mode is not selected, i.e., the "OHP plus slipsheet" mode is selected, the process enters Step P18 shown in FIG. 9B.

Where the judgment in Step P10 indicates that not the OHP presentation mode but the "OHP plus slipsheet" mode is selected, there is no need to copy original images on normal sheets. To judge whether the two-sided document original sheet is to be reversed to be fed again to the image formation position J or the next document original sheet is to be fed to the image formation position J, it is judged whether or not the back side of a two-sided document original sheet has just been subjected to the copying operation (Step P18). Since the original image on the back side of the document original sheet is first copied, the document original sheet is reversed and fed again to the image formation position J (Step P19), and the process sequence from Step P4 to Step P9 is implemented again to subject the front side of the document original sheet to the copying operation. As a result, it is determined in Step P18 that the front side of the document original sheet has just been subjected to the copying operation and, therefore, it is judged whether or not there is any document original sheet to be next subjected to the copying operation in the document original setting position 21 (Step P20). If there is a document original sheet to be next subjected to the copying operation, the process sequence from Step P1 to Step P9 is repeated until all the document original sheets set in the document original setting position 21 are subjected to the copying operation.

On the other hand, if it is determined in Step P10 that the OHP presentation mode is selected, copies are also made on normal sheets. To confirm the copy mode for normal sheets, it is judged in Step P11 whether or not the two-side copying operation is to be performed to make copies on both sides of normal sheets. If it is determined that the two-side copying operation is not to be performed, i.e., the one-side copy mode is selected, a normal sheet is taken in from the upper deck 53A, middle deck 53B, lower deck 53C or large volume deck 54, and an original image is copied on one side of the normal sheet, which is then discharged into one of the sort bins T1 to Tm (Step P21). At this time, the counter C2 is incremented to count the number $C_2$ of normal sheets on which copies are made (Step P22). Then, it is judged whether or not the count value $C_2$ reaches a number $N_2$ which is preliminarily inputted from the operation section S in the mode setting to set the number of copies to be made on normal sheets from a single original image. The process sequence from Step P21 to Step P22 is repeated until the count value $C_2$ reaches the number $N_2$.

Every time the process sequence from Step P21 to Step P22 is completed, the sort bin for receiving a normal sheet formed with the copy image is switched to the next sort bin. The number $N_2$ to be inputted is equal to the number of participants in the presentation. Therefore, normal sheets respectively carrying the same original images copied on the front sides thereof are obtained in a sorted state in the sort bins T1 to Tm in a number equal to the number of participants.

When the count value $C_2$ reaches the number $N_2$ after the aforesaid process sequence is repeated, it is judged whether or not the back side of a two-sided document original sheet has just been subjected to the copying operation (Step P18). Since the original image on the back side of the document original sheet is first copied, the document original sheet is reversed and fed again to the image formation position J (Step P19). The process sequence from Step P4 to Step P11 and from Step P21 to Step P23 is repeated until all the document original sheets set in the document original setting position 21 are subjected to the copying operation.

If it is determined in Step P11 that the two-side copying operation is selected to make copies on the both sides of a normal sheet, it is judged whether or not a normal sheet is accommodated in the intermediate tray 67 (Step P12). If it is determined that no normal sheet is accommodated in the intermediate tray 67, a normal sheet is taken in from one of the upper deck 53A, middle deck 53B, lower deck 53C or large volume deck 54, and an original image is copied on the normal sheet, which is then accommodated in the intermediate tray 67 (Step P13). At this time, the counter C2 is incremented in the same manner as in Step P22 to count the number $C_2$ of normal sheets on which copies are made (Step P14). Then, it is judged whether or not the count value $C_2$ reaches the number $N_2$ (Step P15), and the process sequence from Step P13 to Step P14 is repeated until the count value $C_2$ reaches the number $N_2$. As a result, $N_2$ normal sheets carrying the original image copied on the front sides thereof are accommodated in the intermediate tray 67.

Then, it is judged in Step P18 whether or not the back side of the document original sheet has just been subjected to the copying operation. Since the original image on the back side of the document original sheet is first copied, the document original sheet is reversed and fed again to the image formation position J in Step P19, and the process sequence from Step P4 to Step P15 is implemented again. After the implementation of the process sequence from Step P4 to Step P15, it is determined in Step 12 whether or not a normal sheet is accommodated in the intermediate tray 67.

When the presence of the normal sheet in the intermediate tray 67 is thus determined in Step P12, a normal sheet carrying the original image copied on one side thereof is taken out of the intermediate tray 67. After an original image is copied on the other side, the side carrying no image, of the normal sheet, the normal sheet is discharged into one of the sort bins 1 to Tm (Step P16). The process sequence is repeated until all the normal sheets accommodated in the intermediate tray 67 are taken out to be subjected to the copying operation (Step P17).

Every time the process sequence from Step P16 to Step P17 is completed, the sort bin for receiving normal sheet is switched to the next sort bin.

Since $N_2$ normal sheets each formed with a copy image on the one side thereof are accommodated in the intermediate tray 67 as described above, $N_2$ normal sheets each carrying different images copied on the both sides thereof are obtained in a sorted state in the sort bins T1 to Tm after the repetition of the process sequence from Step P16 to Step P17.

The aforesaid process sequence is repeated until all the document original sheets set in the document original setting position 21 are subjected to the copying operation.

As can be understood from the foregoing, where the OHP presentation mode and the one-side copy mode are designated in the copying machine according to this embodiment, the one-side copying operation is performed to copy an original image on one side of a normal sheet. On the other hand, where the OHP presentation mode and the two-side copy mode are designated, the two-side copying operation is performed to copy original images on the both sides of a normal sheet. Thus, the copying operation on normal sheets can be performed in a manner as desired by the operator. OHP sheets and sets of document copies to be used for the presentation at a meeting can be more conveniently prepared.

In addition, where the OHP presentation mode and the two-side copy mode are designated, the two-side copying operation is performed to copy on the both sides of normal sheets, thereby economizing and saving the normal sheets.

While the embodiment of the present invention has been described, it should be understood that the present invention is not limited to the aforesaid embodiment. For example, although the aforesaid embodiment employs an analog copying machine to explain the present invention, the present invention can be applied to a digital copying machine, laser printer and other image forming apparatuses.

Although the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

What is claimed is:

1. An image forming apparatus comprising:

image forming means for forming identical images both on a sheet of a first type and on a sheet of a second type;

first controlling means for controlling the image forming means to form an image on one side of a sheet of the first type;

second controlling means for controlling the image forming means to form images on both sides of a sheet of the second type;

control means for causing the first controlling means and the second controlling means automatically to control the image forming means so that each time two images are to be formed with one image on each of individual sheets of the first type, both images also are formed on each of respective opposite sides of at least one of the second type of sheets;

a plurality of sheet receiving portions for receiving sheets each formed with at least one image;

means for discharging a sheet of the first type carrying an image formed thereon by the image forming means into a predetermined one of the plurality of sheet receiving portions; and means for discharging a sheet of the second type carrying an image formed thereon by the image forming means into one of the sheet receiving portions other than the predetermined sheet receiving portion.

2. An image forming apparatus as set forth in claim 1, further comprising a sorting mechanism for sorting and discharging a plurality of sheets of the second type respectively formed with identical images into the sheet receiving portions other than the predetermined sheet receiving portion.

3. An image forming apparatus as set forth in claim 1, further comprising means for discharging a sheet of a third type into the predetermined sheet receiving portion before discharging a sheet of the first type into the predetermined sheet receiving portion to attach the sheet of the third type to the sheet of the first type.

4. An image forming apparatus as set forth in claim 3, further comprising third controlling means for controlling the image forming means to form an image on the sheet of the third type.

5. An image forming apparatus as set forth in claim 3, wherein the sheet of the second type and the sheet of the third type are of same type.

6. An image forming apparatus as set forth in claim 1, further comprising:

first sheet retaining means for retaining sheets of the first type;

second sheet retaining means for retaining sheets of the second type; and sheet feeding means for selectively feeding either a sheet of the first type retained in the first sheet retaining means or a sheet of the second type retained in the second sheet retaining means into the image forming means based on the image formation to be performed by the image forming means.

7. An image forming apparatus as set forth in claim 1, wherein the sheet of the first type is a transparent sheet for an overhead projector, and the sheet of the second type is a paper sheet.

8. An image forming apparatus as set forth in claim 1, further comprising document original sheet feeding means for automatically feeding a document original sheet, wherein the image forming means forms an image of the document original sheet fed by the document original sheet feeding means both on a sheet of the first type and on a sheet of the second type.

9. An image forming apparatus as set forth in claim 8, wherein the document original sheet feeding means includes document original sheet reversing means for successively presenting one side and the other side of a document original sheet at a document original presentation position.

10. An image forming apparatus as set forth in claim 1, further comprising:

presentation mode setting means for setting an operation mode of the apparatus to a presentation mode for preparation of presentation materials; and two-side mode setting means for setting the operation mode of the apparatus to a two-side mode for image formation on both sides of a sheet.

11. An image forming apparatus as set forth in claim 1, further comprising:

an intermediate tray for temporarily accommodating a sheet of the second type formed with an image on one side thereof; and a two-side sheet feeding mechanism for introducing the sheet of the second type formed with the image on one side thereof into the intermediate tray and for feeding the sheet of the second type from the intermediate tray to the image forming means for the next image formation on the other side of the sheet of the second type.

12. An image forming apparatus comprising:

image forming means for forming identical images both on a sheet of a first type and on a sheet of a second type;

first controlling means for controlling the image forming means to form an image on one side of a sheet of the first type;

second controlling means for controlling the image forming means to form images on both sides of a sheet of the second type;

a plurality of sheet receiving portions for receiving sheets each formed with at least one image;

means for discharging a sheet of the first type carrying an image formed thereon by the image forming means into a predetermined one of the plurality of sheet receiving portions;

means for discharging a sheet of the second type carrying an image formed thereon by the image forming means into one of the sheet receiving portions other than the predetermined sheet receiving portion; and means for discharging a sheet of a third type into the predetermined sheet receiving portion before discharging a sheet of the first type into the predetermined sheet receiving portion to attach the sheet of the third type to the sheet of the first type.

13. An image forming apparatus as set forth in claim 12, further comprising third controlling means for controlling the image forming means to form an image on the sheet of the third type.

14. An image forming apparatus as set forth in claim 12, wherein the sheet of the second type and the sheet of the third type are of same type.

15. An image forming apparatus comprising:

image forming means for forming identical images both on a sheet of a first type and on a sheet of a second type;

first controlling means for controlling the image forming means to form an image on one side of a sheet of the first type;

second controlling means for controlling the image forming means to form images on both sides of a sheet of the second type;

control means for causing the first controlling means and the second controlling means to control the image forming means so that, every time images are to be formed on two types of sheets, one-sided copies are made on the sheets of the first type every time two-sided copies are made on the sheets of the second type;

a plurality of sheet receiving portions for receiving sheets each formed with at least one image;

means for discharging a sheet of the first type carrying an image formed thereon by the image forming means into a predetermined one of the plurality of sheet receiving portions; and means for discharging a sheet of the second type carrying an image formed thereon by the image forming means into one of the sheet receiving portions other than the predetermined sheet receiving portion.

16. An image forming apparatus as set forth in claim 15, further comprising a sorting mechanism for sorting and discharging a plurality of sheets of the second type respectively formed with identical images into the sheet receiving portions other than the predetermined sheet receiving portion.

17. An image forming apparatus as set forth in claim 15, further comprising means for discharging a sheet of a third type into the predetermined sheet receiving portion before discharging a sheet of the first type into the predetermined sheet receiving portion to attach the sheet of the third type to the sheet of the first type.

18. An image forming apparatus as set forth in claim 15, further comprising:

first sheet retaining means for retaining sheets of the first type;

second sheet retaining means for retaining sheets of the second type; and sheet feeding means for selectively feeding either a sheet of the first type retained in the first sheet retaining means or a sheet of the second type retained in the second sheet retaining means into the image forming means based on the image formation to be performed by the image forming means.

19. An image forming apparatus as set forth in claim 15, further comprising:

presentation mode setting means for setting an operation mode of the apparatus to a presentation mode for preparation of presentation materials; and two-side mode setting means for setting the operation mode of the apparatus to a two-side mode for image formation on both sides of a sheet.

20. An image forming apparatus as set forth in claim 15, further comprising:

an intermediate tray for temporarily accommodating a sheet of the second type formed with an image on one side thereof; and a two-side sheet feeding mechanism for introducing the sheet of the second type formed with the image on one side thereof into the intermediate tray and for feeding the sheet of the second type from the intermediate tray to the image forming means for the next image formation on the other side of the sheet of the second type.

* * * * *